US010208747B2

(12) United States Patent
Cummings

(10) Patent No.: US 10,208,747 B2
(45) Date of Patent: Feb. 19, 2019

(54) TRAP FOR PUMP TESTING AND MONITORING SYSTEMS

(71) Applicant: Beacon Technical Systems, LLC, Pullman, WA (US)

(72) Inventor: Eugene M. Cummings, Lake Forest, IL (US)

(73) Assignee: Beacon Technical Systems, LLC, Pullman, WA (US)

( * ) Notice: Subject to any disclaimer, the term of this patent is extended or adjusted under 35 U.S.C. 154(b) by 217 days.

(21) Appl. No.: 15/424,573

(22) Filed: Feb. 3, 2017

(65) Prior Publication Data

US 2017/0227000 A1 Aug. 10, 2017

Related U.S. Application Data

(60) Provisional application No. 62/335,473, filed on May 12, 2016, provisional application No. 62/292,981, filed on Feb. 9, 2016, provisional application No. 62/293,316, filed on Feb. 9, 2016.

(51) Int. Cl.
*F04B 51/00* (2006.01)
*F04B 23/02* (2006.01)

(52) U.S. Cl.
CPC ..... *F04B 51/00* (2013.01); *F04B 23/021* (2013.01)

(58) Field of Classification Search
CPC ..... F04B 51/00
USPC ..... 73/168, 865.8, 865.9; 417/63, 212–223, 417/1–47; 137/565.37, 551, 552, 558, 137/559
See application file for complete search history.

(56) References Cited

U.S. PATENT DOCUMENTS

| | | | | |
|---|---|---|---|---|
| 3,687,425 | A * | 8/1972 | Katz | B01D 47/021 261/114.1 |
| 4,186,419 | A | 1/1980 | Sims | |
| 4,222,711 | A | 9/1980 | Meyer | |
| 4,456,432 | A * | 6/1984 | Mannino | F04D 13/068 417/2 |
| 5,216,288 | A | 6/1993 | Greene | |
| 5,234,319 | A | 8/1993 | Wilder | |
| D358,560 | S | 5/1995 | George | |
| 5,549,456 | A | 8/1996 | Burrill et al. | |
| 5,640,995 | A | 6/1997 | Packard | |
| 5,672,050 | A | 9/1997 | Webber et al. | |
| D388,055 | S | 12/1997 | Mariotta | |

(Continued)

OTHER PUBLICATIONS

Web Page, Protector, The Protector Control, http://www.floodnot.com/products_icontrol_battery_sump_pump.html, Copyright 1998-2012 Basement Flood Protector (2 pages).

(Continued)

*Primary Examiner* — Robert R Raevis
(74) *Attorney, Agent, or Firm* — Jared L. Cherry; Richard M. Edge

(57) ABSTRACT

A liquid barrier trap for a pump testing and monitoring system is disclosed herein. The liquid barrier provides a barrier to exhaust gases and fluids from escaping a pit that includes the pump under test. The pit may be a sump pit or an ejector pit. The liquid barrier may include a P-trap. The liquid barrier may include an inlet conduit in fluid communication with a valve for admitting water thereto. The liquid barrier may include an outlet fluid conduit extending through a pit cover and permitting water to be admitted into the pit.

20 Claims, 8 Drawing Sheets

(56) References Cited

U.S. PATENT DOCUMENTS

| | | | | |
|---|---|---|---|---|
| 5,793,294 | A | 8/1998 | Schepka | |
| D399,493 | S | 10/1998 | Nakajima | |
| 5,967,759 | A | 10/1999 | Jurado | |
| 6,005,483 | A | 12/1999 | West | |
| D442,560 | S | 5/2001 | Price | |
| 6,257,833 | B1 | 7/2001 | Bates | |
| 6,322,325 | B1 | 11/2001 | Betlehradek | |
| 6,366,053 | B1 | 4/2002 | Belehradek | |
| 6,565,325 | B2 | 5/2003 | Belehradek | |
| 6,631,097 | B2 | 10/2003 | Su | |
| 6,676,382 | B2 | 1/2004 | Leighton et al. | |
| 7,015,819 | B2 | 3/2006 | Collings | |
| 7,307,538 | B2 | 12/2007 | Kochan, Jr. | |
| 7,309,216 | B1 | 12/2007 | Spadola, Jr. et al. | |
| 7,373,817 | B2 | 5/2008 | Burdi et al. | |
| 7,429,842 | B2 | 9/2008 | Schulman | |
| 7,458,782 | B1 | 12/2008 | Spadola, Jr. et al. | |
| 7,612,529 | B2 | 11/2009 | Kochan, Jr. | |
| D618,186 | S | 6/2010 | Solow | |
| 7,830,268 | B1 | 11/2010 | MacDonald | |
| 7,880,625 | B2 | 2/2011 | Almoumen | |
| 7,931,447 | B2 | 4/2011 | Levin | |
| D642,083 | S | 7/2011 | Blanc | |
| 8,149,122 | B2 | 4/2012 | Burza | |
| 8,180,496 | B2 | 5/2012 | Scoleri et al. | |
| 8,186,975 | B2 | 5/2012 | Kochan, Jr. | |
| D663,746 | S | 7/2012 | Kwon | |
| 8,226,371 | B2 | 7/2012 | Kochan | |
| 8,297,937 | B2 | 10/2012 | Johnson | |
| 8,429,967 | B2 | 4/2013 | Kim et al. | |
| 8,436,559 | B2 | 5/2013 | Kidd | |
| 8,579,600 | B2 | 11/2013 | Vijayakumar | |
| 8,591,198 | B2 | 11/2013 | Kochan, Jr. et al. | |
| D710,901 | S | 8/2014 | Brokenshire | |
| D712,735 | S | 9/2014 | Kodera | |
| 8,907,789 | B2 | 12/2014 | Kochan | |
| 9,051,830 | B2 | 6/2015 | Stiles | |
| D740,698 | S | 10/2015 | Cummings | |
| D741,815 | S | 10/2015 | Cummings | |
| 9,404,501 | B2 | 8/2016 | Cummings | |
| 9,523,366 | B2 | 12/2016 | Cummings | |
| 9,525,309 | B2 | 12/2016 | Cummings | |
| 9,528,512 | B2 | 12/2016 | Cummings | |
| 9,528,520 | B2 | 12/2016 | Cummings | |
| 9,528,522 | B2 | 12/2016 | Cummings | |
| 9,528,523 | B2 | 12/2016 | Cummings | |
| 9,528,873 | B2 | 12/2016 | Cummings | |
| 9,534,593 | B2 | 1/2017 | Cummings | |
| 9,534,606 | B2 | 1/2017 | Cummings | |
| 2002/0047783 | A1 | 4/2002 | Bergum et al. | |
| 2002/0069916 | A1 | 6/2002 | Ferguson et al. | |
| 2002/0096050 | A1* | 7/2002 | Miles | B01D 45/14 95/270 |
| 2002/0102162 | A1 | 8/2002 | Belehradek | |
| 2002/0117214 | A1 | 8/2002 | Tucker et al. | |
| 2003/0171895 | A1 | 9/2003 | Harris | |
| 2004/0011194 | A1 | 1/2004 | Lederer | |
| 2004/0055363 | A1 | 3/2004 | Bristol | |
| 2004/0255977 | A1 | 12/2004 | Slocum et al. | |
| 2006/0235573 | A1 | 10/2006 | Guion | |
| 2006/0277980 | A1 | 12/2006 | Kristiansen | |
| 2007/0078610 | A1 | 4/2007 | Adams | |
| 2007/0277306 | A1* | 12/2007 | Grooms | E03F 5/0408 4/613 |
| 2008/0031752 | A1 | 2/2008 | Littwin et al. | |
| 2009/0162211 | A1 | 6/2009 | Kochan, Jr. et al. | |
| 2009/0208345 | A1 | 8/2009 | Moore et al. | |
| 2010/0111724 | A1 | 5/2010 | Chou | |
| 2010/0119379 | A1 | 5/2010 | Becker | |
| 2011/0077875 | A1 | 3/2011 | Tran et al. | |
| 2011/0273288 | A1 | 11/2011 | Kochan, Jr. et al. | |
| 2011/0311370 | A1 | 12/2011 | Sloss et al. | |
| 2012/0199220 | A1 | 8/2012 | Knepp | |
| 2013/0197700 | A1 | 8/2013 | Kochan, Jr. et al. | |
| 2013/0294931 | A1 | 11/2013 | Magnusson | |
| 2014/0039836 | A1 | 2/2014 | Moricca | |
| 2014/0100526 | A1 | 4/2014 | Ueda | |
| 2014/0250580 | A1 | 9/2014 | Magyar | |
| 2014/0368152 | A1 | 12/2014 | Pasche | |
| 2015/0143891 | A1 | 5/2015 | Cummings | |
| 2015/0143892 | A1 | 5/2015 | Cummings | |
| 2015/0143893 | A1 | 5/2015 | Cummings | |
| 2015/0143894 | A1 | 5/2015 | Cummings | |
| 2015/0143895 | A1 | 5/2015 | Cummings | |
| 2015/0143896 | A1 | 5/2015 | Cummings | |
| 2015/0143897 | A1 | 5/2015 | Cummings | |
| 2015/0143900 | A1 | 5/2015 | Cummings | |
| 2015/0144818 | A1 | 5/2015 | Cummings | |
| 2015/0147190 | A1 | 5/2015 | Cummings | |
| 2015/0316936 | A1 | 11/2015 | McCarrick | |
| 2017/0058886 | A1 | 3/2017 | Cummings | |

OTHER PUBLICATIONS

Web Page, NexPump, The Worlds Most Reliable Sump Pump, Ai Extreme "Rage", https://www.nexpump.com/content/Ai_Rage.shtml, Copyrigth 2005-2012 Nexpump, Inc., (2 pages).

Web Page, PittBoss Cellular Pump, Water, and Power Alarm, http://store.pumpalarm.com/PitBoss-Cellular-Alarm-p/s-pb/std.htm?utm_source=Google& . . . , Copyright 2014 PumpAlarm.com LLC (3 pages).

Web Page, How Stuff Works, How Sump Pumps Work, Murray Anderson, at least as early as Jun. 10, 2011, http://home.howstuffworks.com/home-improvement/plumbing/sump-pump4.htm, (3 pages).

Saltzman, R. What Happens When Your Sump Pump Fails? StarTribune. May 24, 2012. <URL: http://www.startribune.com/local/yourvoices/153532145.html>.

PCT/US2014/065347 International Search Report and Written Opinion for Sump Pump Test and Monitoring System.

PCT/US2014/065866 International Search Report and Written Opinion for Test and Monitoring System for a Dual Sump Pump Installation.

PCT/US2014/065867 International Search Report and Written Opinion for Test and Monitoring System for a Sump Pump Installation Having a Self-Monitoring Valve Module for . . . .

* cited by examiner

TRAP FOR PUMP TESTING AND MONITORING SYSTEMS

RELATED APPLICATIONS

This application claims the benefit under 35 U.S.C. § 119(e) of U.S. Provisional Application No. 62/335,473, filed 12 May 2016, naming Eugene M. Cummings as inventor, and titled "Liquid Barrier Trap for Pump Testing Systems"; Provisional Application No. 62/292,981, filed 9 Feb. 2016, naming Eugene M. Cummings as inventor, and titled "Sump Pump Test and Monitoring System"; and to U.S. Provisional Application No. 62/293,316, filed 9 Feb. 2016, naming Eugene M. Cummings as inventor, and titled "Ejector Pump Test and Monitoring System", each of which is hereby incorporated by reference herein in its entirety.

BRIEF DESCRIPTION OF THE DRAWINGS

The present disclosure will be more fully understood by reference to the following detailed description of one or more preferred embodiments when read in conjunction with the accompanying drawings, in which.

DETAILED DESCRIPTION

Figure 1:
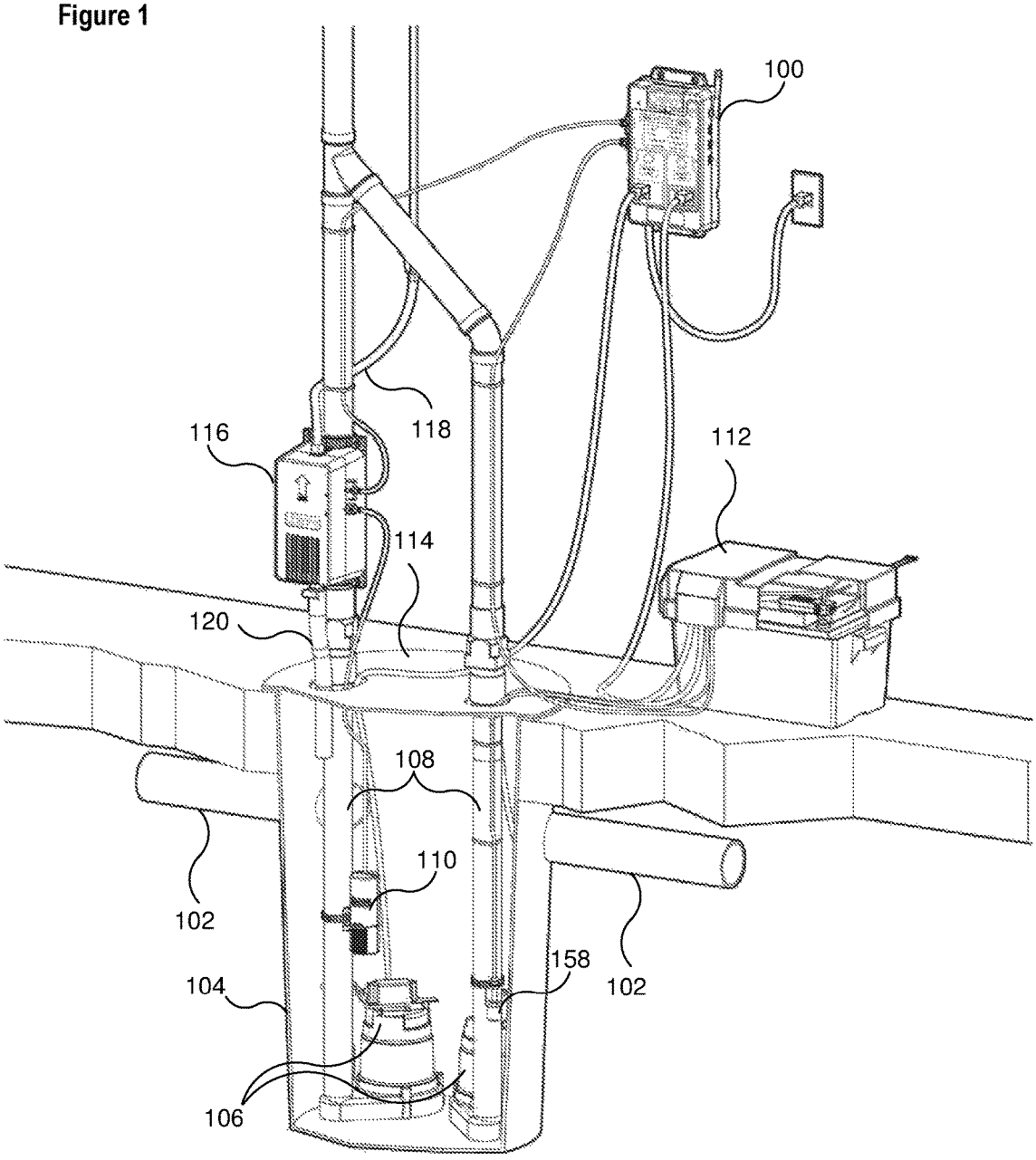
FIG. 1 illustrates a view of a system consistent with embodiments of the present disclosure.

The embodiments of the disclosure will be best understood by reference to the drawings, wherein like parts are designated by like numerals throughout. It will be readily understood that the components of the disclosed embodiments, as generally described and illustrated in the figures herein, could be arranged and designed in a wide variety of different configurations. Thus, the following detailed description of the embodiments of the systems and methods of the disclosure is not intended to limit the scope of the disclosure, as claimed, but is merely representative of possible embodiments of the disclosure. In addition, the steps of a method do not necessarily need to be executed in any specific order, or even sequentially, nor need the steps be executed only once unless otherwise specified.

In some cases, well-known features, structures or operations are not shown or described in detail. Furthermore, the described features, structures, or operations may be combined in any suitable manner in one or more embodiments. It will also be readily understood that the components of the embodiments, as generally described and illustrated in the figures herein, could be arranged and designed in a wide variety of different configurations.

The present disclosure pertains to sump pumps and various systems and methods to test the operation of such pumps. In various embodiments, a sump pump may be operable to remove water from a sump pit. Further, a test system may be utilized to periodically confirm the operability of a sump pump installation and alert the owner of a malfunction prior to the sump installation being required to operate to discharge drain water. Such testing may permit an owner to identify and correct any potential impediments to the operation of the system and thereby avoid what might otherwise be a flooding event. In the event the test and monitoring system of the disclosure is utilized in a two pump installation, both pumps are independently tested and monitored, and a failure of either pump, or both pumps, results in an alarm being sounded and appropriate messages being sent to the owner and/or the owners' designee(s) by communications channels such as, for example, the Internet, cell phone data or land line telephone communication channels.

Various embodiments consistent with the present disclosure may include a system for periodically testing the operation of a sump pump using a liquid trap. The liquid trap may permit water to be introduced into a sump pit for the purpose of testing the operation of the sump pump while maintaining a seal that prevents gas from exiting the trap. In various embodiments, the sump pit may be covered and/or sealed, such as an ejector pit. Ejector pits may require a sealed pit cover to block the passage of exhaust gases, smells, liquids and other fluids into an occupied or enclosed area. As described in greater detail below, various embodiments of the present disclosure are configured to permit periodic testing of the sump pumps while the pit cover remains in place.

A waterless trap that complies with the ASME/ANSI A112-18.8 standard may be utilized in various embodiments consistent with the present disclosure. A waterless trap may include a valve or membrane that permits liquid to flow in one direction while creating a seal to liquids or gases flowing in the other direction. In one specific embodiment, the HEPvO® valve available from Hepworth Building Products Limited of Yorkshire England may be utilized.

Systems and methods consistent with the present disclosure may be designed for easy installation in existing single and dual sump pump environments without changes to existing hardware. Such systems may monitor primary and battery backup pumps and periodically test one or more pumps under actual operating conditions by admitting fresh water into the sump pit. In some embodiments, a system may be configured to test the operation of the primary pump and/or backup pump according to a schedule (e.g., every seven days). Further, in some embodiments, tests may be initiated manually.

The system may provide audible and visual alerts regarding various parameters associated with the system. For example, alters may be provided for mechanical and electrical pump failures, power interruptions, water levels, and/or weak backup battery level. In some embodiments, alerts may be communicated electrically through an electronic communications interface. The system may include, for example, an 802.11 interface configured to connect to a Wi-Fi network. Alerts may be sent through the 802.11 interface in the form of email messages, text messages, telephone calls that play a recorded message, etc. Still further, the electronic communications interface may be configured to send status information and/or alerts to an application configured to operate on a mobile device.

FIG. 1 illustrates a view of a system consistent with embodiments of the present disclosure. Sump pump installations may be used in residential and commercial basements to remove ground water that accumulates around foundation footings and under the basement floor. To this end, a network of apertured drain tiles or flexible drain hoses (not shown) may be laid adjacent to the footings of the foundation walls on either the interior side or the exterior side of the walls, or both. These drain tiles or hoses may be routed and sloped to direct accumulated water into a sump pit 104 through inlets 102.

One or more sump pumps 106 may be disposed in the sump pit 104. The sump pumps 106 may be in communication with a control module 100. In various embodiments, the sump pumps 106 may be electrically-powered pumps that are designed to be at least partially submerged by water in the sump pit. When activated, sump pumps 106 may discharge water from the sump pit 104 through discharge pipes 108 to a dispersal location, such as a storm sewer or exterior dispersal field.

A float switch 110 may be disposed in the sump pit 104 and may trigger activation of an alarm when the level of water (or other liquid) in the sump pit has reached a predetermined trigger level. The activation point of the float may be set below the lowest inlet 102. The float switch 110 may also typically terminate an alarm when the water in the sump pit 104 falls below a predetermined minimum level below the trigger level. In various embodiments, a check valve (not shown) may be disposed in the discharge pipes 108 to prevent water remaining in the discharge pipes 108 from flowing back into the sump pit 104.

Should one or both of sump pumps 106 fail to operate for any reason (e.g., pump failure, power failure, etc.), any water that cannot be accommodated in the sump pit 104 will eventually overflow from the top of the sump pit and cause a flood. This flooding may cause damage to items stored nearby, to improvements such as finished walls, to floor coverings, etc. In some embodiments, a backup power source 112 may be provided to reduce the likelihood of a flood being caused by a power failure. A secondary switch 158 may be in communication with the backup power source 112 and may be used to activate one of the sump pumps 106 using power from the backup power source 112 during a power outage.

A valve module 116 may be in communication with the control module 100 and a water source 118. The control module 100 may cause the valve module 116 to permit water from the water source 118 to discharge into the sump pit 104 through a tube 120. The water from the valve module 116 may be limited to an amount that is insufficient to completely fill the sump pit 104, but that is sufficient to activate the sump pumps 106. As such, the system may confirm that the sump pumps activate as expected without risking a flood. In the event that the sump pumps fail to activate as expected, control module 100 may alert the owner or operator of the building in which the sump pumps are installed that action is needed to repair the system before any flooding occurs. In various embodiments, the alert may take the form of an audible alert, a visual alert (e.g., activation or blinking of a LED), or a message (e.g., an email, a text message, a recorded message delivered via telephone, etc.). In various embodiments, control module 100 may connect to the Internet through a wired or wireless network interface.

The sump pit 104 may be covered for a variety of reasons, such as building codes and building construction and maintenance practices, by a pit cover 114. Furthermore, in some instances, the sump pit 104 may be an ejector pit that is used to eject sewage to a drain. As noted above, a liquid barrier may be provided to prevent gases and odors from passing from the sump pit 104 into an occupied or enclosed area, such as a home or other building.

Figure 2A:
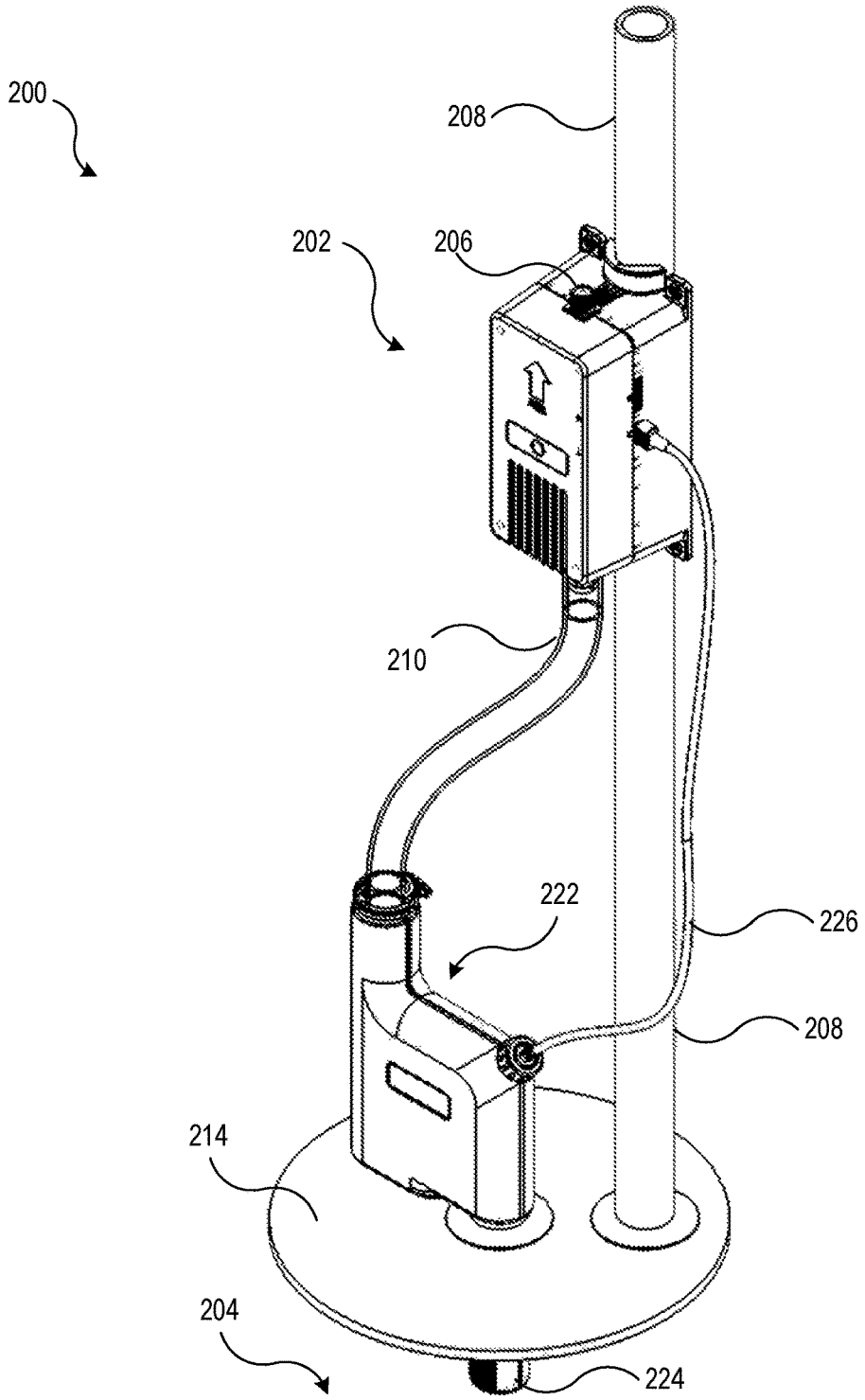
FIG. 2A illustrates a perspective view of a sump pump testing system with a liquid barrier in accordance with several embodiments herein.

FIG. 2A illustrates a perspective view of a portion of a pump testing and monitoring system 200 and a liquid trap for admitting water into a pit 204 through a pit cover 214 using a liquid trap. As has been described above, certain sump pump installations may include a pit cover 214 (such as a sump pit cover, an ejector pit cover, or the like). As is noted above, such testing may involve the introduction of water into the pit 204 containing a pump (not shown) to be tested. Accordingly, the liquid trap housing 222 may comprise a liquid trap configured to block gases and possibly other fluids from entering into a protected space (such as a basement, elevator shaft, building, or the like) while permitting water to be admitted during a test cycle.

A valve module 202 may be used to introduce water into the sump pit 204 containing the pump (not shown) during testing. The valve module 202 may be connected to a water supply line through a supply port 206. A supply valve, which is described in greater detail below, may be actuated to permit water to flow from the supply line into a hose 210 that is connected to a liquid trap housing 222.

The pit cover 214 may include an aperture configured to accept a pipe 208. The pipe 208 may be used to vent liquids or gases from the pit 204. In some embodiments, more than one pipe may be provided. For example, one pipe may extend to an exterior of the enclosed area, such as to an exterior of a building, and another pipe may be connected to a sump pump and may be used to pump water from the pit 204.

A liquid level switch 224 may be disposed in the pit 204 to selectively activate an alarm when water in the pit reaches a threshold level. In the illustrated embodiment, the liquid level switch 224 is disposed within a portion of the liquid trap housing 222 that extends below the pit cover 214. Water may flow through the liquid level switch 224 when it is admitted into the pit during a testing cycle. In various embodiments, the liquid level switch 224 may be embodied as a float switch. The liquid level switch 224 may be in communication with the valve module 202 via a cable 226, which may also house electronics for activating an alarm. In various embodiments, the electronics for activating the pump may be disposed in a separate module.

Water may be admitted to the pit 204 during a test of the pump. During such a test, the valve module 202 may be configured to open a valve and to allow a quantity of water to pass into the pit 204 through hose 210 and liquid trap housing 222. In some embodiments, the flow of water during a test may be stopped based on a signal from the liquid level switch 224. In other words, when the liquid level switch 224 is activated, the flow of water may be discontinued. In other embodiments, a specified volume of water may be discharged in connection with a test. In still other embodiments, the valve may remain open for a specified period of time.

Figure 2B:
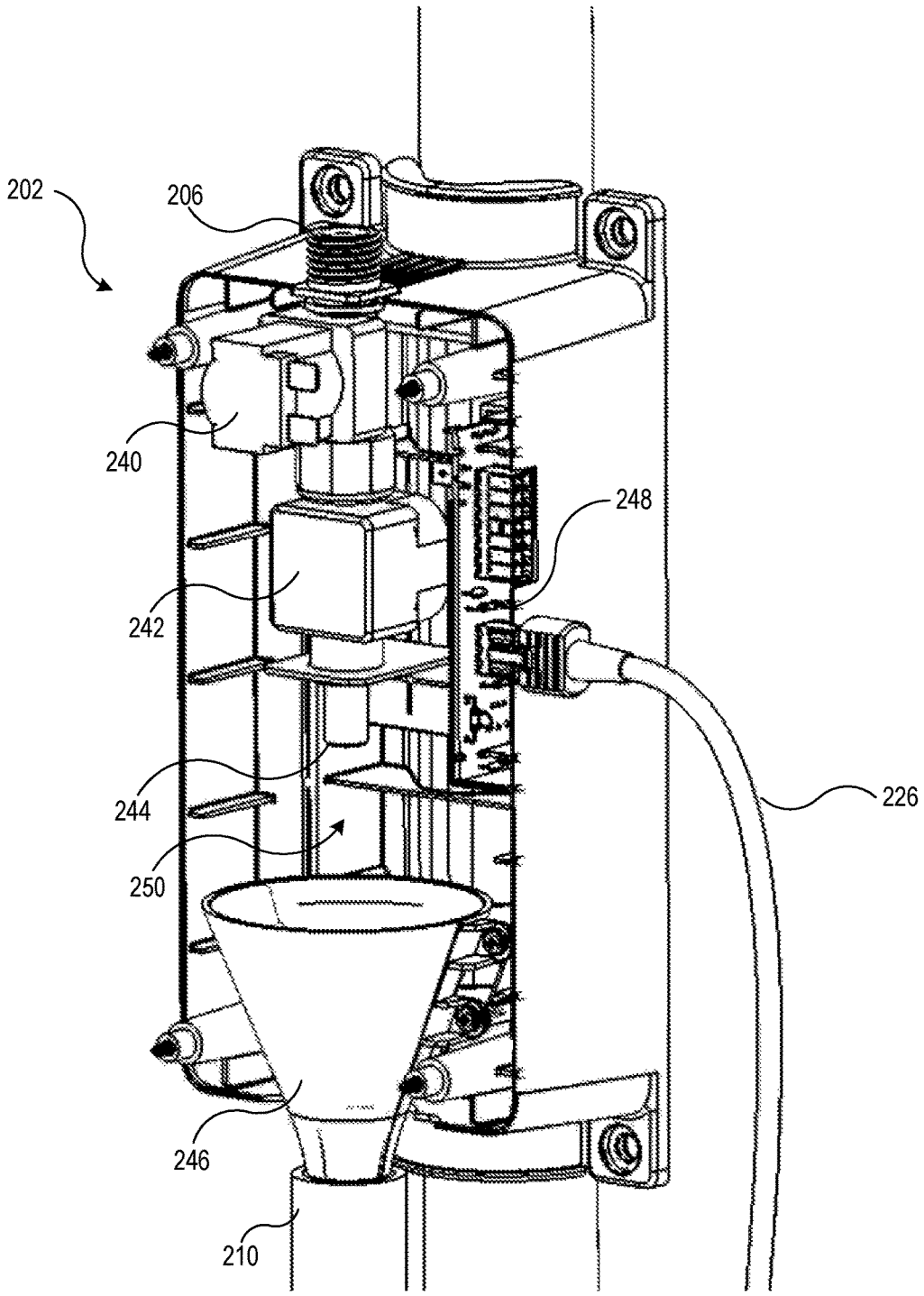
FIG. 2B illustrates an enlarged view of the valve module illustrated in FIG. 2A, in which a cover of the valve module has been removed to show certain components of the valve module consistent with embodiments of the present disclosure.

FIG. 2B illustrates an enlarged view of the valve module 202 illustrated in FIG. 2A, in which a cover of valve module 202 has been removed to show the internal components of the valve module 202 consistent with embodiments of the present disclosure. The supply port 206 may be in communication with a valve 240. In the illustrated embodiment, the valve 240 may comprise a solenoid valve. In various embodiments, the valve 240 may be selectively activated to enable water to flow from the supply port 206 through the valve 240.

A flow meter 242 may be configured to determine when water is flowing and/or to determine a volume of water that flows through the flow meter 242. In some embodiments, the flow meter may be configured to determine whether valve 240 has failed. For example, if the flow meter 242 detects that water is flowing when a test is not active, an alarm may be sounded and/or a message may be communicated to the user.

An outlet 250 may direct a flow of water to a funnel 246. The funnel 246 may catch a flow of water discharged from the outlet 244 after crossing an air gap 250 and direct the flow of water to hose 210. The air gap 250 may be configured to prevent liquid from the pit from flowing up the hose 210 and into the valve module. In various embodiments, the air gap may satisfy backflow prevention requirements imposed by building codes applicable in various jurisdictions.

Electronics 248 disclosed in valve module 240 may be configured to activate valve 240 to perform a test of a pump and/or to monitor the flow of water using flow sensor 242.

Figure 2C:
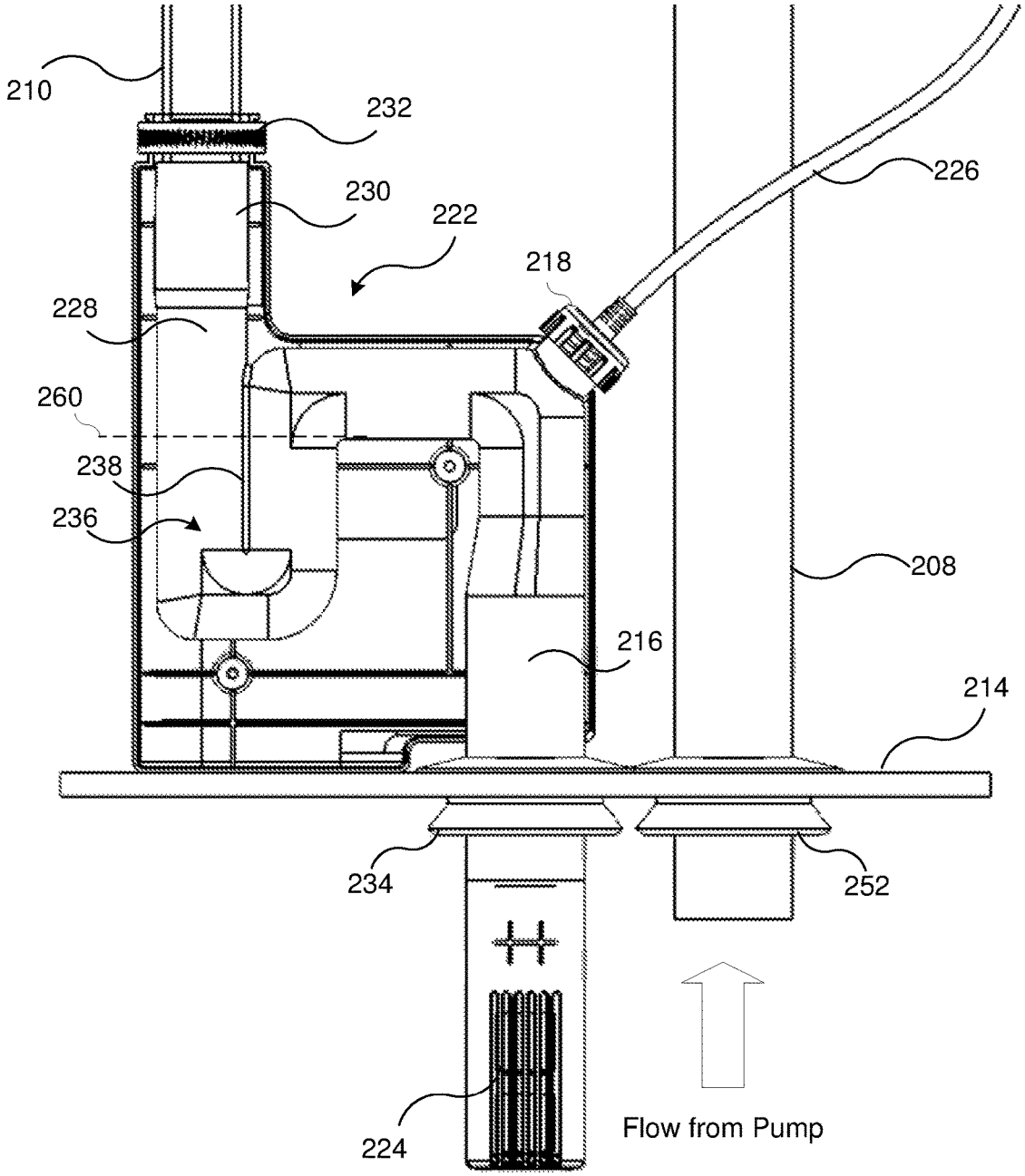
FIG. 2C illustrates an enlarged view of the liquid trap housing illustrated in FIG. 2A, in which a cover of the liquid trap housing is removed to show a liquid trap consistent with embodiments of the present disclosure.

FIG. 2C illustrates an enlarged view of the liquid trap housing illustrated in FIG. 2A, in which a cover of the liquid trap housing 222 is removed to show a liquid trap 228 consistent with embodiments of the present disclosure. In the illustrated embodiment the liquid trap comprises a P-trap. The liquid trap 228 includes an inlet conduit 230 in liquid communication with the valve module via the hose 210. In the illustrated embodiment, a hose clamp 232 is used to secure the hose 210 to the liquid barrier the liquid trap housing 222. An outlet conduit 228 extends through the pit cover 214 and permits water to be admitted into the pit. A seal 234 may be disposed around the portion of the liquid trap 228 that passes through the pit cover 214. Similarly, a seal 252 may be disposed around pipe 208. A cable port 218 may be configured to pass the cable 226 associated with the float switch 224 through the liquid trap 228.

The liquid trap 228 may trap a quantity of liquid in area 236. Area 236 is below overflow level 260, which may include a level of two portions of the P-Trap over which the water must overflow in order to proceed from the inlet conduit 230 to the outlet conduit 216. The liquid trap 228 may include a clip 238 extending below the overflow level 260. Due to the overflow level 260 and the clip 238, the P-trap may trap water to form a liquid barrier to gases. In one embodiment, the liquid trap 228 provides a three-inch standing water column. The liquid trap 228 provides a barrier to effluent gases and other fluids from passing from the pit into the protected area through the pump testing and monitoring system.

Figure 3:
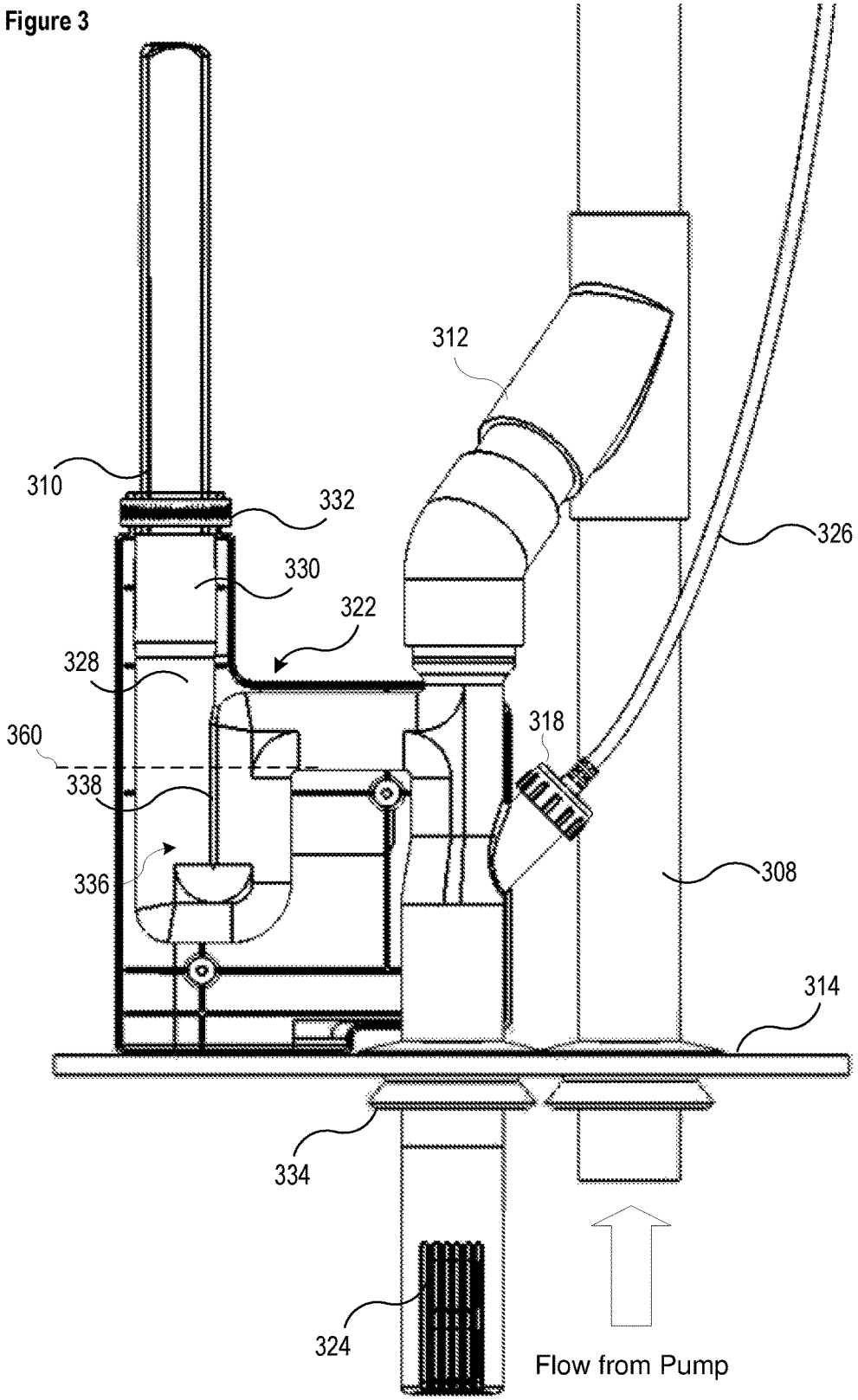
FIG. 3 illustrates a perspective view of a liquid trap including an exhaust conduit consistent with embodiments of the present disclosure.

FIG. 3 illustrates a perspective view of a liquid trap including an exhaust conduit 312 consistent with embodiments of the present disclosure. According to one embodiment, the exhaust conduit 312 may lead to a separate gas exhaust pipe (not separately illustrated) that may lead out of a structure. A cover of a liquid trap housing 322 is removed to show a liquid trap 328. In the illustrated embodiment the liquid trap comprises a P-trap. In other embodiments, other configurations may be used, such as a U-trap, an S-trap, a drum trap, a bag trap, a bell trap, and the like. In the illustrated embodiment, the liquid trap 328 includes an inlet conduit 330 in liquid communication with a hose 310. A hose clamp 332 is used to secure a hose 310 to the liquid barrier and the liquid trap housing 322. An outlet conduit 328 extends through the pit cover 314 and permits water to be admitted into the pit. The liquid trap 328 may include a clip 338 extending below the overflow level 360. Due to the overflow level 360 and the clip 338, the P-trap may trap water to form a liquid barrier in area 336 that prevents the flow of gases through the liquid trap 328. A seal 334 may be disposed around the portion of the liquid trap 328 that passes through the pit cover 314. A cable port 318 may be configured to pass the cable 326 associated with the float switch 324 through the liquid trap 328.

A flow of liquid from the pump may also be directed into the pipe 308 when the pump is active. In one embodiment, the exhaust conduit 312 is in connection with a pipe 308 that may be configured to receive a flow of liquid from a pump in the pit. According to one embodiment, the exhaust conduit 312 may be provided to allow gases to pass into a gas exhaust pipe within the pipe 308. In another embodiment, the exhaust conduit 312 may be in fluid connection with pipe 308. In this particular embodiment, a one-way valve may be disposed in the exhaust conduit 312 to prevent water from flowing from pipe 308 through the exhaust conduit 312 and draining back into the pit. In one particular embodiment, another one-way valve may be disposed in pipe 308 above the junction of exhaust conduit 312 with pipe 308, the one-way valve prohibiting a flow of liquid back to the one-way valve disposed in the exhaust conduit 312 such that gasses may pass through the one-wave valve disposed in the exhaust conduit 312 without back pressure from liquid against the one-way valve in exhaust conduit 312.

Figure 4:
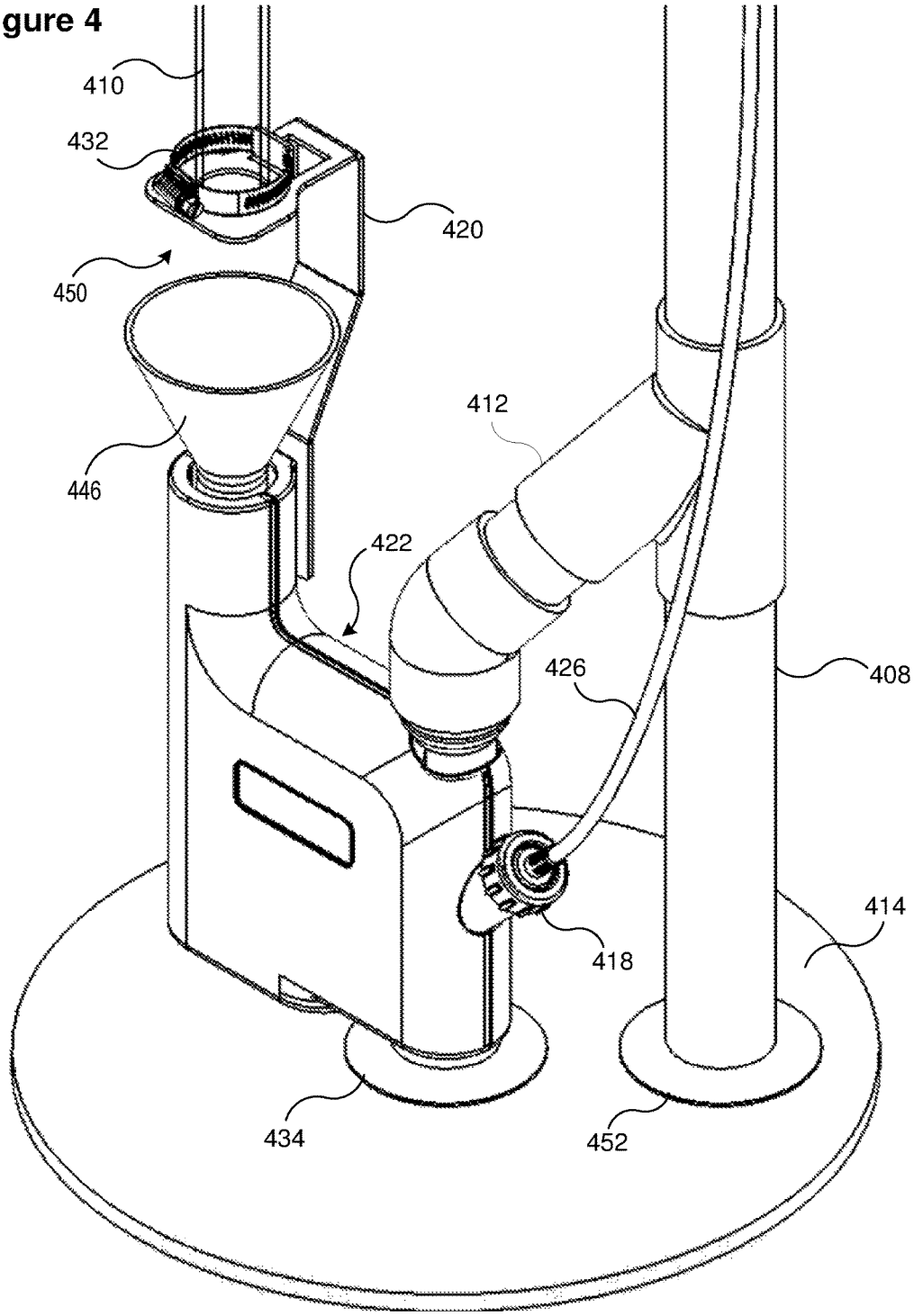
FIG. 4 illustrates a perspective view of a liquid trap housing including an air gap consistent with embodiments of the present disclosure.

FIG. 4 illustrates a perspective view of a liquid trap housing including an air gap consistent with embodiments of the present disclosure. A liquid trap 422 may be configured to permit water to be admitted to a pit located below pit cover 414. An exhaust conduit 412 is in fluid connection with a pipe 408 that may be configured to receive a flow of liquid from a pump in the pit. Seals 434 and 452 may be associated with pipe 408 and a liquid trap that passes through pit cover 414. A cable 426 may be in electrical communication with a liquid level switch used to detect when the water level in the pit exceeds a threshold. The cable 426 may exit the liquid trap housing 422 through a cable port 418.

A bracket 420 may maintain the position of a hose 410 over a funnel 446 to create an air gap. The air gap 450 may prevent liquid from the pit from flowing up to the hose 410. The bracket 420 may be affixed to the liquid trap housing 422. A hose clamp 432 may be used to couple the hose 410 to the bracket 420.

Figure 5:
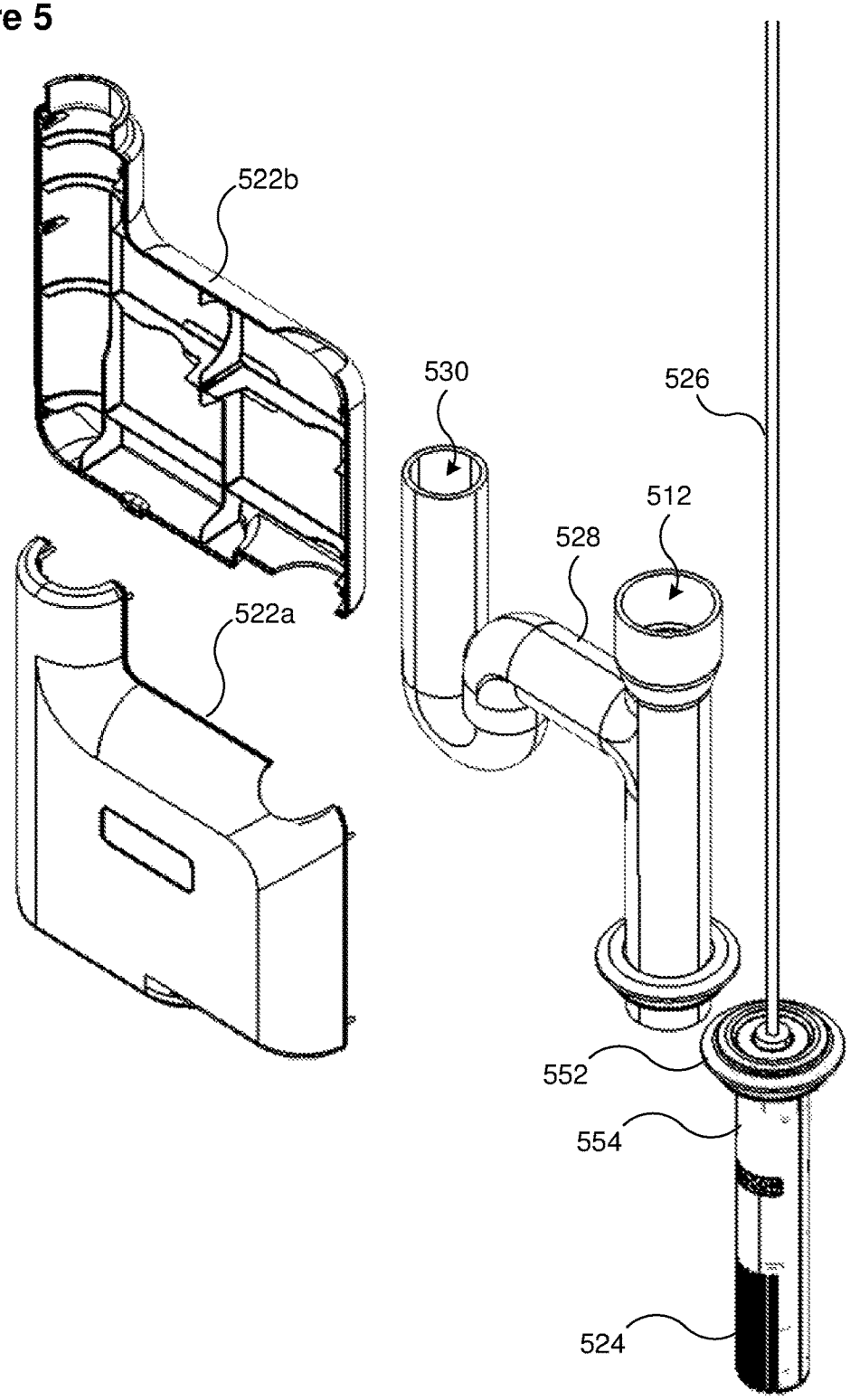
FIG. 5 illustrates a partially exploded perspective view of a liquid trap housing and a liquid trap with an exhaust vent consistent with embodiments of the present disclosure.

FIG. 5 illustrates a partially exploded perspective view of a liquid trap housing 522*a*, 522*b* and a liquid trap 528 with an exhaust vent 512 consistent with embodiments of the present disclosure. Gases from the pit may be vented through exhaust vent 512. In the illustrated embodiment, the liquid trap comprises a P-trap. The liquid trap 528 includes an inlet conduit 530 configured to receive liquid from a pump test system configured to introduce a volume of water into a sump pit. The water may enter the inlet conduit 530, pass through the P-trap, and drain into the sump pit.

In the embodiment illustrated in FIG. 5, the liquid level switch 524 and liquid level switch housing 554 is separated from the liquid trap 528. A seal 552 may be disposed between the liquid level switch housing 554 and a pit cover (not shown). A cable 526 may pass through seal 552 and may be in communication with a system.

Figure 6:
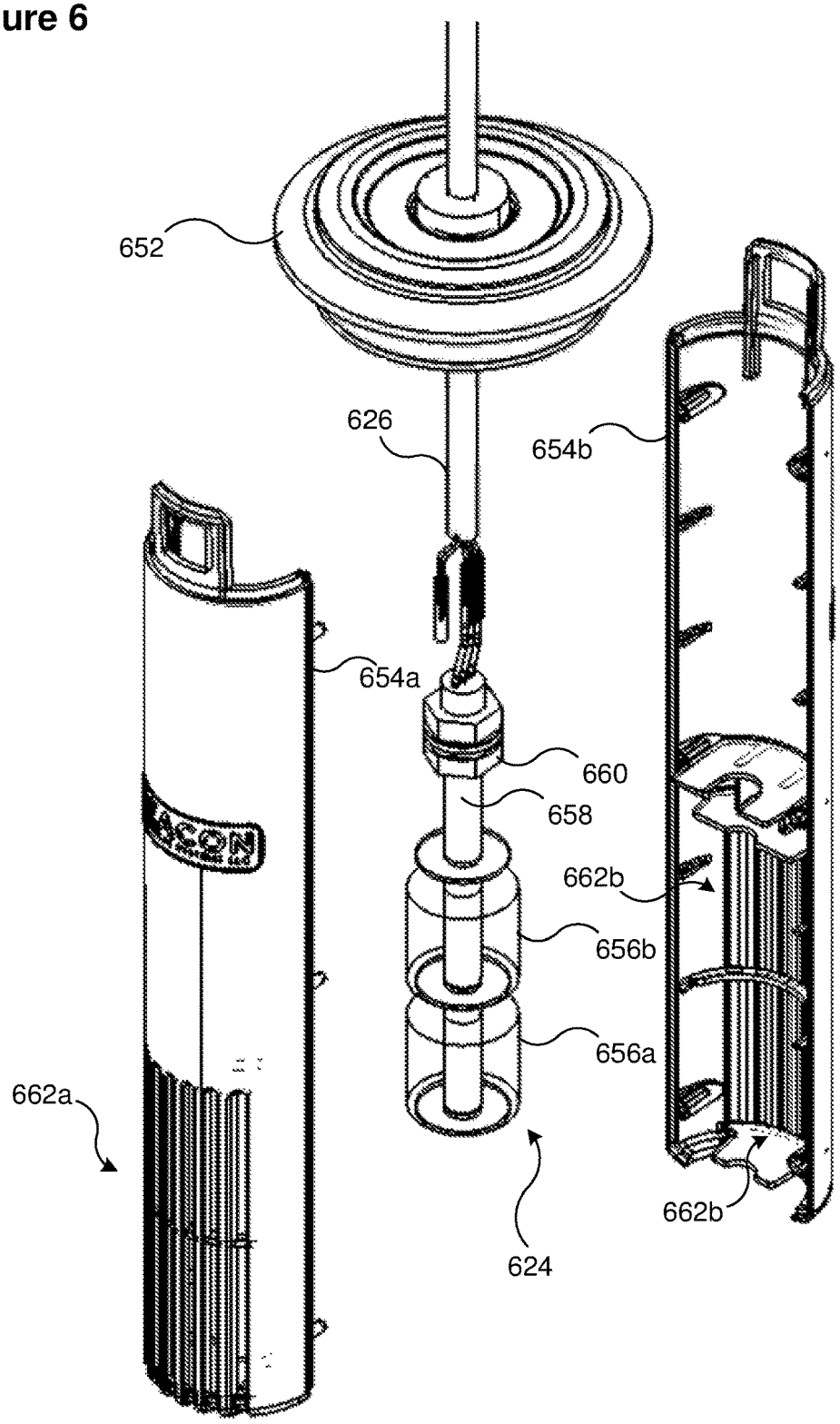
FIG. 6 illustrates a partially exploded perspective view of a liquid level switch and housing consistent with embodiments of the present disclosure.

FIG. 6 illustrates a partially exploded perspective view of a liquid level switch 624 and housing 654*a*, 654*b* consistent with embodiments of the present disclosure. The liquid level switch housing 654*a*, 654*b* includes a plurality of apertures 662*a*, 662*b* that permit water to come into contact with floats 656*a*, 656*b*.

The liquid level switch 624 includes floats 656*a*, 656*b* that are configured to float upward when submerged in water. The buoyancy of the floats 656*a*, 656*b* may exert an upward force on a shaft 658 that is coupled to a switch 660. The switch 660 may be activated upon the exertion of a threshold force. A signal from the switch 660 may be transmitted via a cable 626. Cable 626 may pass through a seal 652 disposed in a pit cover (not shown) and may connect to a system operable to activate an alarm when the water level detected by the liquid level switch 624 exceeds a threshold level.

While specific embodiments and applications of the disclosure have been illustrated and described, the disclosure is not limited to the precise configurations and components disclosed herein. Accordingly, many changes may be made to the details of the above-described embodiments without departing from the underlying principles of this disclosure. The scope of the present invention should, therefore, be determined only by the following claims.

What is claimed is:

1. A system comprising:

a control module;

a sump pump in communication with the control module and configured to be disposed within a sealed sump pit;

a valve module configured to be in fluid communication with a liquid source and configured to selectively discharge a volume of liquid from the liquid source during a test cycle based on a signal from the control module;

a liquid barrier configured to receive the volume of liquid and to direct the volume of liquid into the sealed sump pit, the liquid barrier comprising:

an inlet conduit configured to receive the volume of liquid;

an outlet conduit in fluid communication with the pit;

a liquid trap in fluid communication with the inlet conduit and the outlet conduit configured to trap a portion of the volume of liquid, the trapped portion of the volume of liquid creating a liquid seal between the inlet conduit and the outlet conduit, the liquid seal configured to block gas from passing the sealed pit to the inlet conduit.

2. The system of claim 1, wherein the sealed pit comprises an ejector pit.

3. The system of claim 1, wherein the liquid barrier further comprises a gas exhaust conduit in fluid communication with the sealed pit and separated from the inlet by the liquid trap, the gas exhaust conduit configured to vent gas from the sealed pit.

4. The system of claim 1, wherein the liquid barrier comprises one of a P-trap and an S-trap.

5. The system of claim 1, further comprising a liquid level switch in communication with the control module, the liquid level switch configured to be disposed within the sealed pit and configured to detect a liquid level in the sealed pit.

6. The system of claim 5, wherein the liquid level switch comprises a float switch.

7. The system of claim 5, wherein the liquid level switch is in electrical communication with a high water alarm configured to alarm when the liquid level switch is activated.

8. The system of claim 5, wherein the liquid level switch is physically separate from the liquid barrier.

9. The system of claim 5, further comprising a liquid barrier housing configured to enclose the liquid barrier and the liquid level switch.

10. The system of claim 9, wherein a portion of the liquid barrier housing configured to enclose the liquid level switch extends into the sump pit.

11. The system of claim 10, further comprising a cable port configured to permit a cable to exit the liquid barrier and to create a fluid seal around the cable, wherein the cable configured to convey an electrical signal from the liquid level switch to the control module.

12. The system of claim 1, further comprising an air-gap in fluid communication with the inlet conduit and configured to provide an air gap between the inlet conduit and the liquid source, the air gap configured to prevent backflow of a liquid from the sump pit into the liquid source.

13. The system of claim 12, further comprising:

a hose in fluid communication with the liquid source;

a bracket configured to be coupled to the hose and the liquid barrier and to maintain the air gap between an outlet of the hose and the inlet conduit.

14. The system of claim 12, wherein the air gap is disposed within the valve module.

15. The system of claim 1, further comprising a seal configured to be disposed around the liquid barrier at a position where the liquid barrier enters the sump pit.

16. A liquid barrier configured to receive a volume of liquid from a liquid source during a test cycle of a sump pump disposed within a sealed sump pit, the liquid barrier comprising:

an inlet conduit configured to receive the volume of liquid;

an outlet conduit in fluid communication with the pit;

a liquid trap in fluid communication with the inlet conduit and the outlet conduit configured to trap a portion of the volume of liquid, the trapped portion of the volume of liquid creating a liquid seal between the inlet conduit and the outlet conduit, the liquid seal configured to block gas from passing the sealed pit to the inlet conduit.

17. The system of claim 16, wherein the sealed pit comprises an ejector pit.

18. The system of claim 16, wherein the liquid barrier further comprises a gas exhaust conduit in fluid communication with the sealed pit and separated from the inlet by the liquid trap, the gas exhaust conduit configured to vent gas from the sealed pit.

19. The system of claim 16, wherein the liquid barrier comprises one of a P-trap and an S-trap.

20. The system of claim 16, further comprising a cable port configured to permit a cable to exit the liquid barrier and to create a fluid seal around the cable.

* * * * *